US011043754B2

(12) United States Patent
Yesil et al.

(10) Patent No.: US 11,043,754 B2
(45) Date of Patent: Jun. 22, 2021

(54) METHOD AND APPARATUS FOR MULTI-FEED MULTI-BAND MIMO ANTENNA SYSTEM

(71) Applicant: Airties Kablosuz Iletisim Sanayi Ve Dis Ticaret A.S., Istanbul (TR)

(72) Inventors: Mehmet Ali Yesil, Istanbul (TR); Emre Aydin, Istanbul (TR); Ali Arsal, Istanbul (TR)

(73) Assignee: Airties Kablosuz Iletisim Sanayi Ve Dis Ticaret A.S., Istanbul (TR)

( * ) Notice: Subject to any disclaimer, the term of this patent is extended or adjusted under 35 U.S.C. 154(b) by 0 days.

(21) Appl. No.: 16/479,537

(22) PCT Filed: Jan. 25, 2018

(86) PCT No.: PCT/IB2018/000130
§ 371 (c)(1),
(2) Date: Jul. 19, 2019

(87) PCT Pub. No.: WO2018/138580
PCT Pub. Date: Aug. 2, 2018

(65) Prior Publication Data

US 2019/0363455 A1 Nov. 28, 2019

Related U.S. Application Data

(60) Provisional application No. 62/450,359, filed on Jan. 25, 2017.

(51) Int. Cl.
*H01Q 21/24* (2006.01)
*H01Q 5/30* (2015.01)
*H01Q 1/52* (2006.01)

(52) U.S. Cl.
CPC ..... *H01Q 21/24* (2013.01); *H01Q 1/521* (2013.01); *H01Q 5/30* (2015.01)

(58) Field of Classification Search
CPC .. H01Q 5/10; H01Q 5/20; H01Q 5/30; H01Q 5/378; H01Q 5/392; H01Q 5/50; H01Q 1/521; H01Q 9/04
See application file for complete search history.

(56) References Cited

U.S. PATENT DOCUMENTS 6,624,789 B1 * 9/2003 Kangasvieri ..... H01Q 1/243 343/702
9,325,067 B2 * 4/2016 Ali ..... H01Q 9/145
(Continued)

FOREIGN PATENT DOCUMENTS

JP 2011-078037 4/2011

OTHER PUBLICATIONS

Wu et al., "A Printed Diversity Dual-Band Monopole Antenna for WLAN Operation in the 2.4- and 5.2GHz Bands," Microwave and Optical Technology Letters, vol. 36, No. 6, pp. 436-439 (Feb. 2003).
(Continued)

*Primary Examiner* — Jason Crawford
(74) *Attorney, Agent, or Firm* — Volpe Koenig

(57) ABSTRACT

According to aspects of the disclosure, a multi-feed multi-band MIMO antenna system comprises at least two antennas orthogonally positioned with respect to each other, which are operating over two different frequency ranges; at least two out-of-band resonators coupled with the two antennas respectively; and, at least two other in-band resonators coupled with the two antennas respectively and designed to decrease mutual coupling in the frequency ranges, where the first resonator filters out signals having the second frequency range leaking into a first antenna, while the second resonator filters out other signals having the first frequency range leaking into a second antenna.

14 Claims, 5 Drawing Sheets

(56) References Cited

U.S. PATENT DOCUMENTS

| | | | | |
|---|---|---|---|---|
| 2009/0096699 | A1 | 4/2009 | Chiu et al. | |
| 2009/0295643 | A1* | 12/2009 | Angell | H01Q 5/40 343/700 MS |
| 2011/0175789 | A1* | 7/2011 | Lee | H01Q 5/20 343/853 |
| 2012/0013519 | A1* | 1/2012 | Hakansson | H01Q 1/36 343/835 |
| 2012/0329407 | A1* | 12/2012 | Rousu | H01Q 3/2605 455/90.2 |
| 2013/0069842 | A1* | 3/2013 | Lee | H01Q 21/28 343/853 |
| 2013/0257674 | A1* | 10/2013 | Li | H01Q 5/378 343/853 |
| 2016/0240930 | A1 | 8/2016 | Cozzolino | |
| 2017/0084997 | A1* | 3/2017 | Wu | H01Q 1/50 |
| 2017/0229759 | A1* | 8/2017 | Wu | H01Q 13/16 |
| 2018/0076505 | A1* | 3/2018 | Hu | H01Q 5/50 |

OTHER PUBLICATIONS

Pozar, "Microstrip Antennas," Proceedings of the IEEE, vol. 80, No. 1, pp. 79-91 (Jan. 1992).

IEEE Standard for Information technology—Telecommunications and information exchange between systems—Local and metropolitan area networks—Specific requirements; Part 11: Wireless LAN Medium Access Control (MAC) and Physical Layer (PHY) Specifications; Amendment 5: Enhancements for Higher Throughput, IEEE Std 802.11n-2009 (Sep. 2009).

* cited by examiner

METHOD AND APPARATUS FOR MULTI-FEED MULTI-BAND MIMO ANTENNA SYSTEM

CROSS REFERENCE TO RELATED APPLICATION

This application claims the benefit of U.S. Provisional Application 62/450,359, filed on Jan. 25, 2017, which is incorporated by reference as if fully set forth.

FIELD OF INVENTION

This disclosure generally relates to wireless networking and more particularly, but not exclusively, to a Multiple Input Multiple Output (MIMO) system and other wireless systems.

BACKGROUND

Wireless communications systems have been researched and developed considerably to satisfy increasing demands for high speed mobile services and applications. For example, Multiple Input Multiple Output (MIMO) system, first introduced into the Wi-Fi area with IEEE 802.11n standard, implements multiple transmit and receive antennas and it provides higher data rates and capacities. The MIMO system exploits the well-known multipath propagation phenomenon to multiply the data rate of the wireless link. Under the assumption that the number of antennas at the transmit side and the receive side is equal, it has been shown that the capacity of the MIMO system, in terms of bps/Hz, increases linearly with the number of antennas.

Since the cost of increasing the transmission bandwidth is high and the usage of higher modulation constellations are limited, utilizing the MIMO in Wi-Fi equipment is more effective, and thus increases the capacity of the wireless system. However, the capacity of the MIMO system depends on the number of transmit and receive antennas as well as on the correlation between the antennas.

The performance of the MIMO system is maximized when channels between each pair of transmit and receive antenna are statistically independent. In order to have independent channels between different pairs of transmit and receive antennas, the channels have to be uncorrelated. If the channels are fully correlated, then the capacity of the MIMO system will reduce to the capacity of a system that employs a single antenna at each side.

The channel correlation mainly depends on a mutual coupling of the antennas. An example of the mutual coupling is electromagnetic interactions between the antennas. Those effects have to be avoided to ensure low correlations between the antennas.

Spatial diversity is one exemplary technique employed to overcome the adverse effect of the mutual coupling. It provides decoupling of the transmitted or received signals by placing the antennas far apart within Wi-Fi equipment like an access point (AP) or a station (STA). The minimum distance required for decorrelation of the channels is equal to a quarter of the signal wavelength. However, due to the size limitations on the Wi-Fi equipment, placing the antennas into the device with this decorrelation distance is often not feasible.

Polarization diversity is another exemplary technique used to avoid mutual coupling. It provides the multiple versions of the transmitted and received signals by utilizing antennas with cross polarizations. The transmitted signals are decorrelated by employing polarization diversity. But, the polarization of the transmitted signals can be changed due to reflections, refractions, and scatterings that occur in the multipath environment. Therefore, employing perfectly vertically or horizontally polarized antennas may not be a good practical choice, where the signals may have both horizontal and vertical polarization components. So, this situation leads us to design antennas that might have both vertical and horizontal polarization components.

Using resonators to cancel the part of the coupled fields between them is another exemplary method to provide isolation between the antennas. A resonator positioned between the two antennas reduces the mutual coupling by manipulating the radiated far field pattern from one antenna towards the neighboring antenna. Actually, these elements which provide isolation by its natural geometric characteristic are called as parasitic elements that are not physically connected to the antennas, but they are connected to the ground structure in order to form a resonator at the center frequency of whole band of interest.

Besides the demand for the bandwidth and the capacity, there is appreciable interest concentrated on the requirements of multi-band operations in Wi-Fi applications, since IEEE 802.11 standards like a/b/g/n/ac cover 2.4-2.5 GHz and 5.15-5.875 GHz bands. Traditional single-feed dual-band design necessitates the use of a diplexer component that implements the frequency-domain multiplexing.

SUMMARY

A multi-feed multi-band MIMO antenna system, utilizing in—band resonators to suppress the mutual coupling between the antennas, out of band resonators to reject the unwanted currents generated by the 5 GHz port, which is disrupting the operation of the 2.4 GHz port and vice versa, and exploits feeding-type diversity to provide extra isolation between the 2.4 GHz and 5 GHz ports in each of the antennas.

BRIEF DESCRIPTION OF THE DRAWINGS

The drawings described below are for illustration purposes only. The drawings are not intended to limit the scope of the present disclosure. Like reference characters shown in the figures designate the same parts in the various implementations.

DETAILED DESCRIPTION OF THE PREFERRED EMBODIMENTS

A method and apparatus for multi-feed multi-band MIMO antenna system, where the feeding ports are positioned orthogonal with respect to each other, are presented to effectively overcome the aforementioned mutual coupling issues originating from the implementation of multiple antennas into the Wi-Fi equipment that have strict requirements on the size of the device and to provide efficient multi-band operation.

The multi-feed multi-band MIMO antenna system utilizes both the cross polarized antennas and in-band resonators to effectively mitigate the mutual coupling effect disrupting the correlation requirements of the MIMO system. Also, out-of-band resonators are employed to decrease the currents on the antenna surface disrupting the multi-band operation.

Moreover, the MIMO antenna system exploits feeding-type diversity and it provides extra out-of-band isolation to converge the amount of out-of-band isolation provided by the diplexers, which increase the layout complexity, the size of the device, and the cost. Therefore, by applying two different feeding mechanisms for the two ports of the dual band antenna, the out-of-band isolation is improved without using extra equipment. As a result, feeding-type diversity provides a low-cost and low-profile solution to decrease undesired out-of-band effects regarding the costly and non-occupant restraint commercial diplexer solution.

The main implementation of the multi-feed multi-band antenna system is related to, but not limited to, Wi-Fi equipment. For example, the antenna system can be implemented in dual band GSM (Global System for Mobile Communications or originally Groupe Special Mobile) equipment with the antenna design parameters appropriate for the dual-band GSM.

Figure 1:
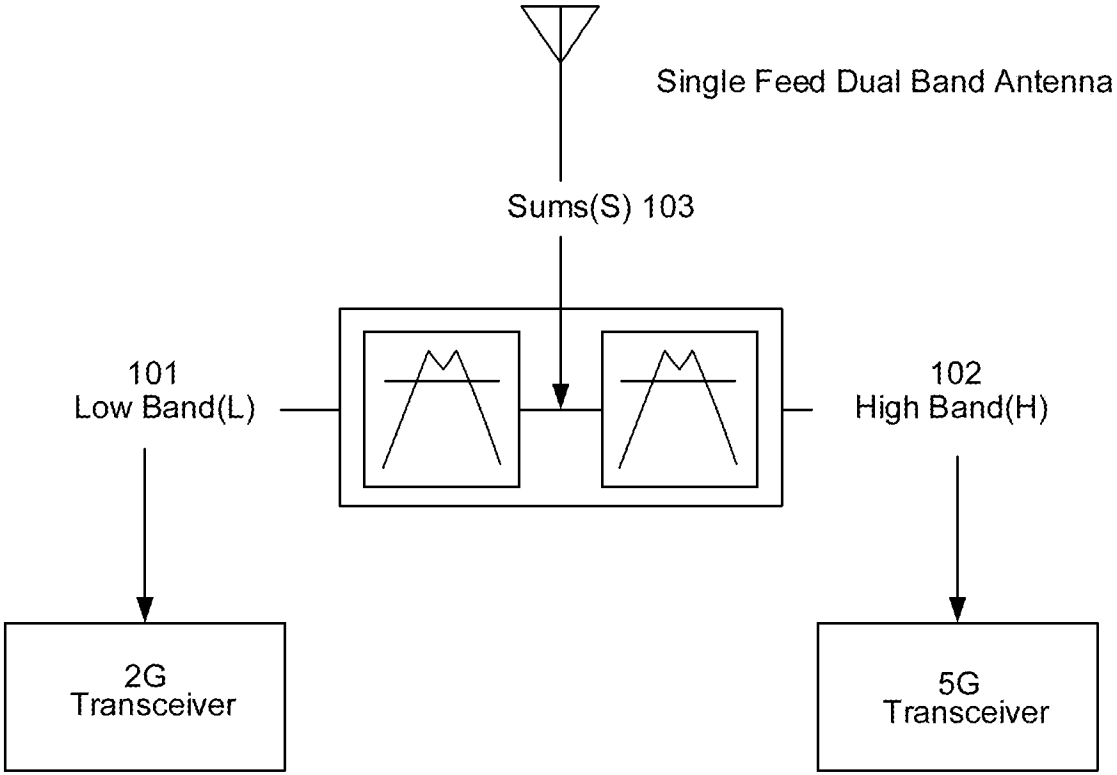
FIG. 1 is an exemplary block diagram of a diplexer multiplexing the 2G and the 5G signals.

FIG. 1 shows a block diagram of the conventional diplexer multiplexing the 2G and 5G frequency components. The two ports, L 101 and H 102 occupying low and high frequency components respectively, are multiplexed onto the Sum (S) 103. The diplexer comprises a low-pass filter connecting ports L 101 and Sum (S) 103 and high pass filter connecting ports H 102 and Sum (S) 103. Although the diplexer allows the coexistence of the signals on L 101 and H 102 on port without interfering each other, the use of the diplexer increases both the layout complexity and size of the device, and thus it is costly.

Figure 2:
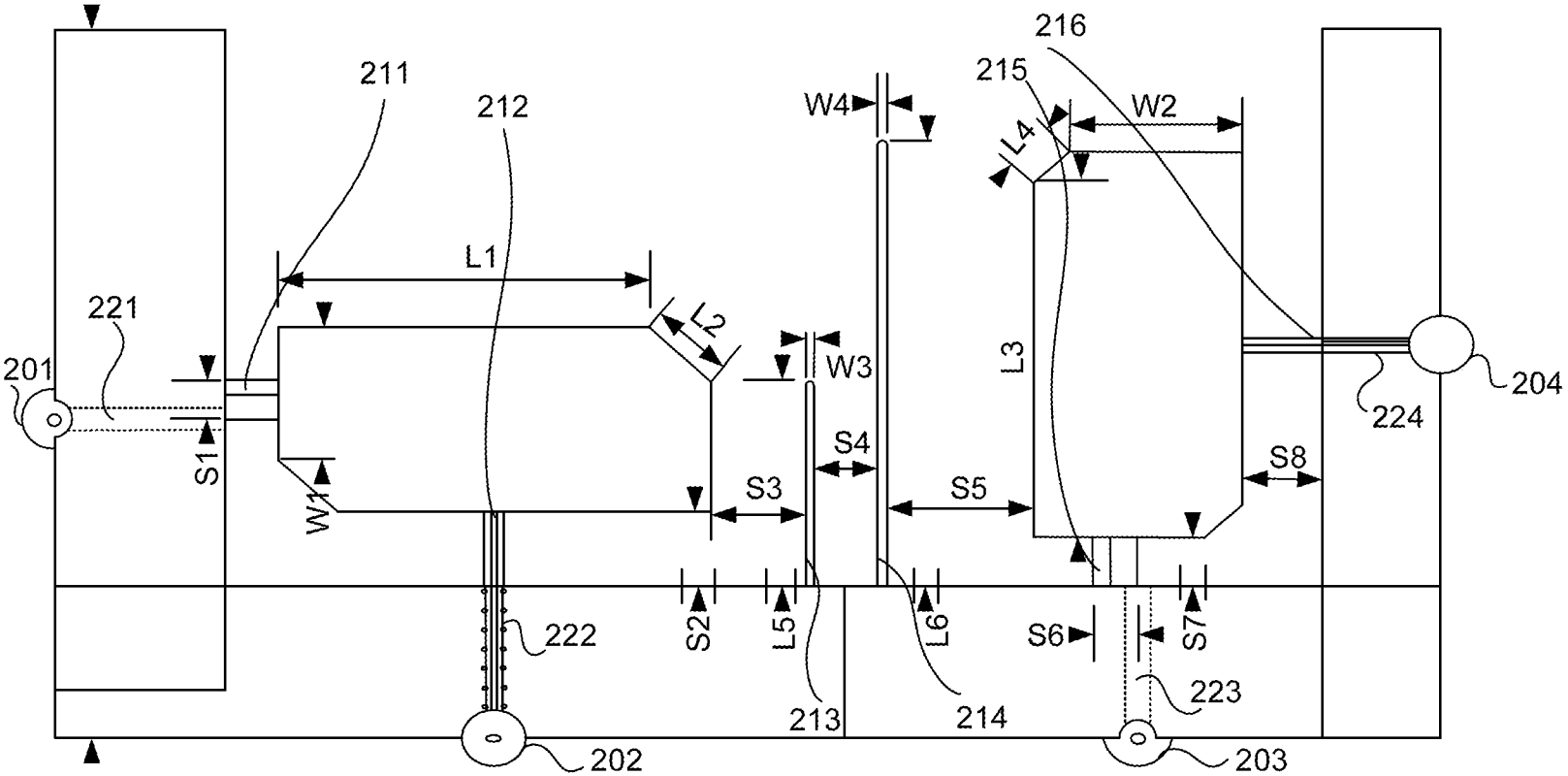
FIG. 2 illustrates an example of the dual-feed dual-band MIMO antenna system.

In one embodiment, as depicted in FIG. 2, the dual-feed dual-band MIMO antenna system can be implemented in Wi-Fi equipment, operating over certain frequency bands like 2.4-2.5 GHz and 5.15-5.875 GHz.

In this embodiment, the rectangular monopole antenna ports 201, 202, 203, 204 are orthogonally positioned with respect to each other to increase the amount of in-band isolation between the antennas. For example, these antennas operate over certain frequency bands like 2.4-2.5 GHz and 5.15-5.875 GHz. The feed line 221 and the feed line 223 feed the 5 GHz radio waves to the rest of the antenna structure during the transmission, and collect the incoming 5 GHz radio waves and convert them into electric currents during the reception. The feed line 222 and the feed line 224 perform the same feeding and converting operations during the transmission and reception of the 2.4 GHz radio waves.

Referring to FIG. 2, the out-of-band isolators, specified as resonator 211 and resonator 215, are utilized to filter out the unwanted 2.4 GHz signals, which are both coupled to 5 GHz lines from the 2.4 GHz feed lines and leaked to 5 GHz feed lines as harmonics of the backend RF circuitry. The distance between the resonator 211 and the feed line 221 is specified as S1, whereas the distance between the resonator 215 and the feed line 223 is specified as S6. The distances S1 and S6 may affect both the isolation frequencies and the return loss values denoting the amount of power reflected from the port 201 and port 203.

The other out-of-band isolators, specified as resonator 212 and resonator 216 are utilized to decrease the unwanted 5 GHz signals which are both coupled to 2.4 GHz lines from the 5 GHz feed lines and leaked to 2.4 GHz feed lines as harmonics of the backend RF circuitry. In order to adjust both the return loss value and the operating frequencies of the port 202 and port 204, the values of S2 and S8 can be configured corresponding to the distances between the feed lines and resonator 212 and resonator 216, respectively.

In FIG. 2, there are also specified lengths on the radiating parts, given as L1, L2, W1, L3, L4 and W2, that affect the radiation characteristic of the antennas. L1, W1, L3 and W2 affect both of the 2.4 GHz and 5 GHz operating frequencies, whereas L2 and L4 affect the 5 GHz operating frequencies. The dimensions specified by L and W may indicate the length of the ground planes and these lengths are empirically adjusted.

In FIG. 2, 5 GHz antenna port 201 and 2.4 GHz antenna port 202 are positioned orthogonal to each other. Also, 203 and 204 are positioned in the same manner. The orthogonal placement of the two different ports with respect to each other provides extra out-of-band isolation between the port 201 and the port 202.

The in-band resonators, denoted as resonator 213 and resonator 214 in FIG. 2, are utilized to strongly decrease the in-band mutual coupling in 5 GHz and 2.4 GHz bands respectively, between the two rectangular monopole antennas. The distances between the resonators and the corresponding radiating parts of the antennas are given as S3 and S5 in FIG. 2. As these two distances are decreased, the operating frequencies are also shifted to the lower frequencies. This effect improves the isolation between the two antennas.

Since the distance between the in-band resonators, specified as S4, is less than a quarter of the wavelength of the 2.4 GHz signal, the resonators affect each other. In order to compensate for this effect, this distance is adjusted proportional to the quarter of the wavelength of the 2.4 GHz signal.

The length of the in-band resonators L5 and L6 can also be chosen as one quarter of the wavelengths of 5 GHz and 2.4 GHz radio waves, respectively, whereas the width of the resonators W3 and W4 may affect the isolation bandwidths.

Figure 3:
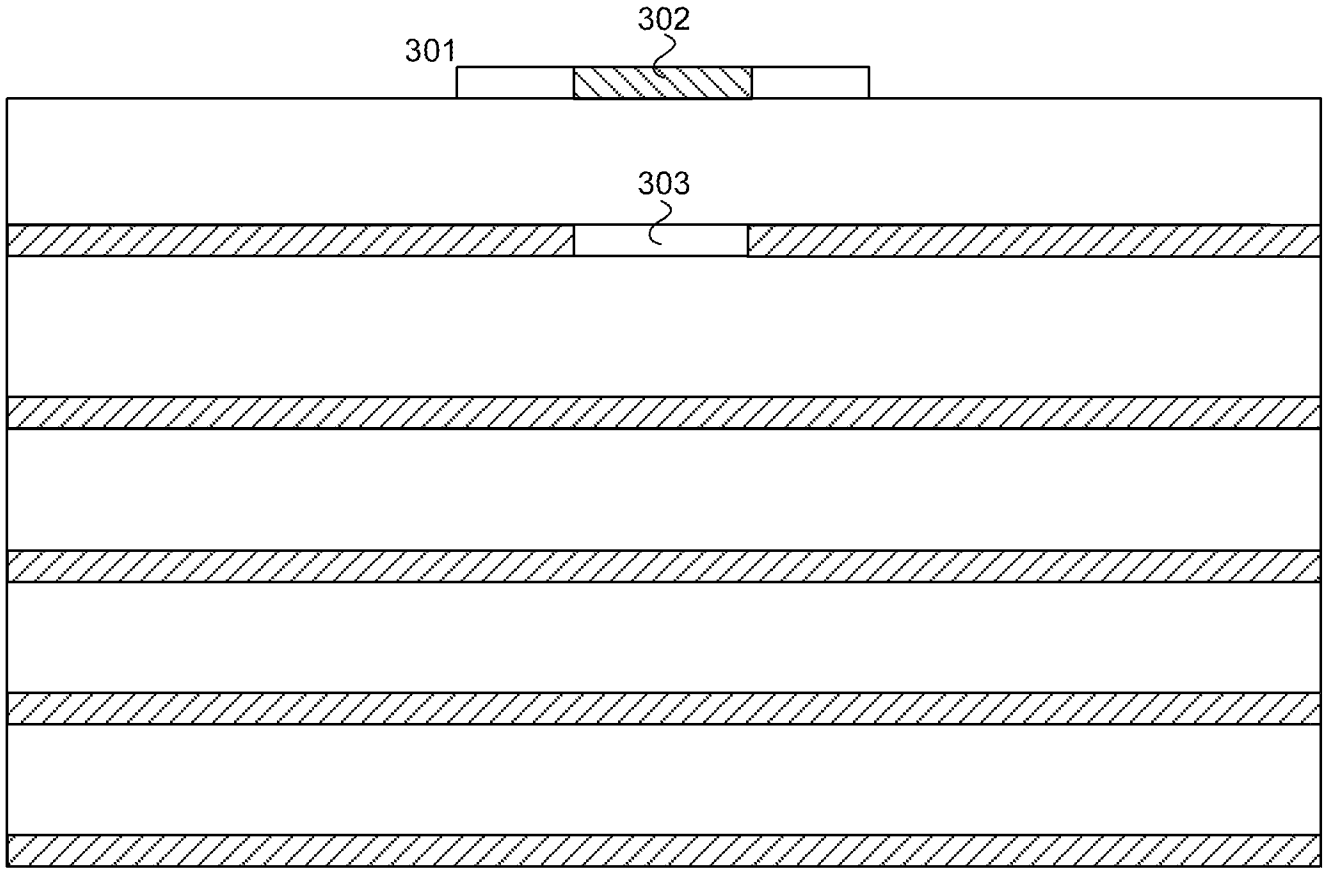
FIG. 3 is an exemplary drawing of layers in the 2.4 GHz port.
Figure 4:
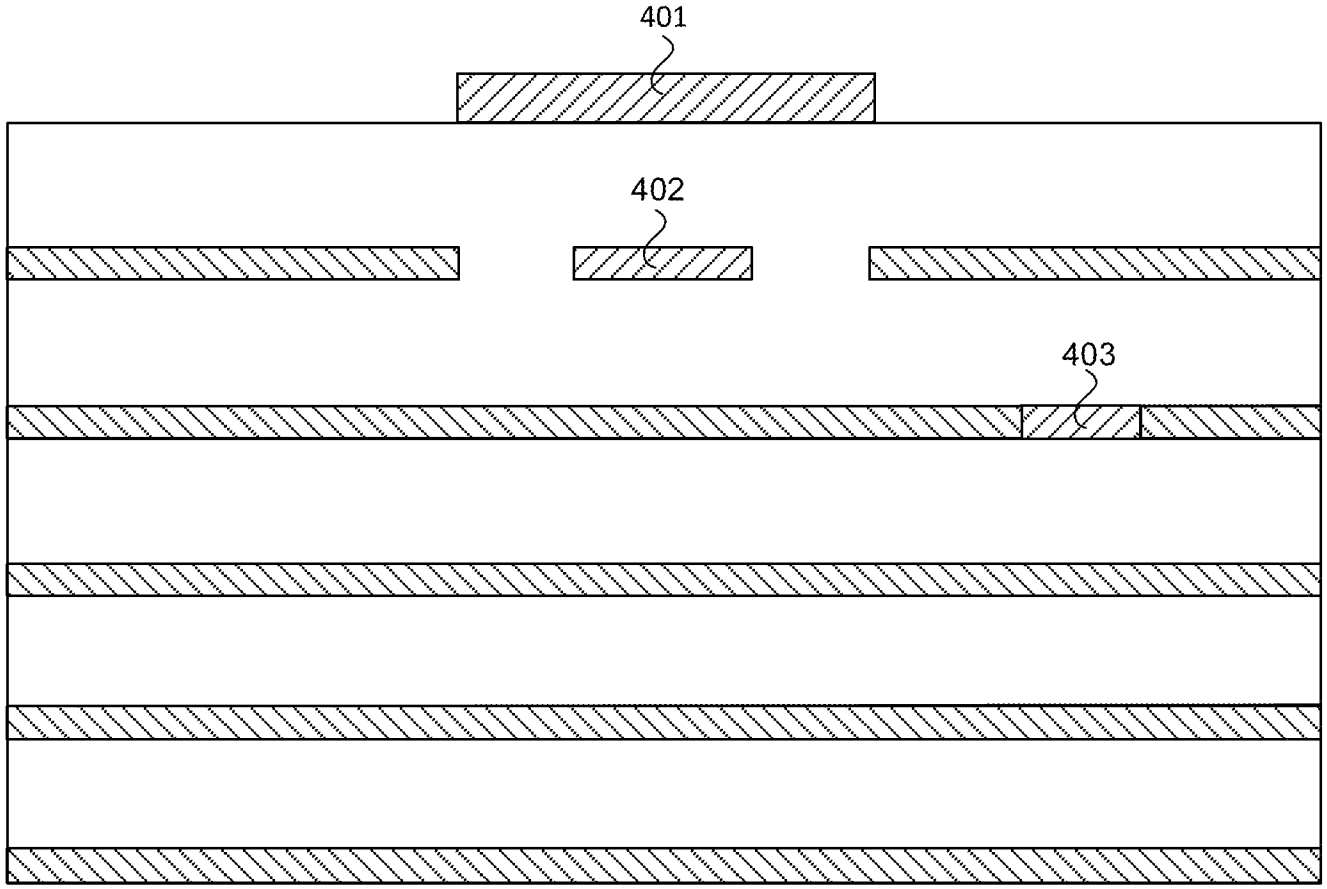
FIG. 4 is an exemplary drawing of layers in the 5 GHz port.

The exemplary layer drawings of the 2.4 GHz ports and 5 GHz ports are depicted in FIGS. 3 and 4, respectively. In FIG. 3, the reference numerals 301 and 302 denote the antenna part and the microstrip feed line, respectively. The reference numeral 303 denotes the resonator utilized to decrease unwanted 5 GHz current on the 2.4 GHz port. In FIG. 4, the reference numerals 401 and 402 denote the antenna part and the proximity feed line, respectively. The resonator denoted by 403 is utilized to decrease unwanted 2.4 GHz current on the 5 GHz port. In order to maintain the out-of-band rejection by eliminating the undesired out-of-band currents, out-of-band resonators are utilized between the radiating part of the antenna and the feeding port, as depicted in FIG. 2.

Our numerical simulations have shown that the out-of-band resonator 303 utilized to decrease the unwanted 5 GHz current component on the 2.4 GHz port is preferably positioned under the 2.4 GHz feed line 301 as depicted in FIG. 3, whereas the out-of-band resonator 403 utilized to decrease the unwanted 2.4 GHz signal is preferably positioned in proximity of the 5 GHz feeding port 402 as depicted in FIG. 4.

In order to provide further out-of-band isolation between the two feeding ports, instead of using commercial diplexers that are costly and not compact in terms of physical size, here feeding-type diversity is exploited. For example, the 5 GHz port of the antenna is fed with proximity coupling technique corresponding to a capacitive feeding, whereas 2.4 GHz port is fed with microstrip transmission line in a conductive manner.

The proximity coupling feeding technique is implemented by not directly connecting the feeding port and the radiating part of the antenna, but instead by exploiting the gap introducing a capacitance into the feed cancelling out the inductance generated by the feeding port. The capacitive structure enhances the system bandwidth and also improves the out-of-band isolation for 5 GHz port. That is, the proximity coupling adds an extra degree of freedom to the antenna design in terms of out-of-band isolation.

Figure 5:
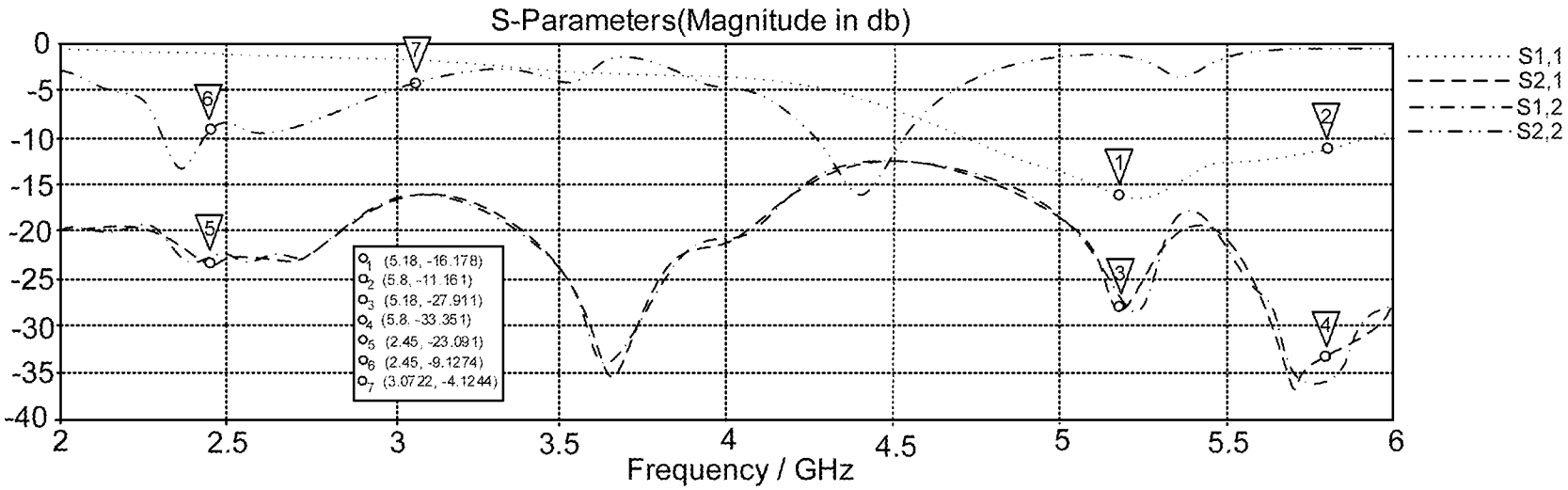
FIG. 5 illustrates S-parameters of the dual band MIMO antenna design.

FIG. 5 provides the plot of the Scattering-Parameters (S-Parameters), quantifying the propagation of the RF energy through a multi-port network in dB scale. In FIG. 5, the maximum isolation provided in the 5 GHz band by the design is −35 dB, whereas the maximum isolation in the 2.4 GHz band is about −23 dB. Thus, the isolation provided by the design in the 5 GHz band is similar to the isolation provided by commercial diplexers at both bands. The results show that the design cancels the necessity of the utilization of the diplexers for out-of-band isolation. As a result, implementing feeding-type diversity provides a low-cost, low-profile, easy-to-implement solution in comparison to the solution provided by the commercial diplexers.

In another embodiment, the dual-feed dual-band antenna system can be utilized in GSM equipment that operates in 900 (890 MHz-960 MHz) and 1800 (1710 MHz-1879.8 MHz) bands. While implementing the dual-feed dual-band system in an equipment operating in GSM 900 and GSM 1800 bands, the same implementation concept with Wi-Fi can be utilized by scaling each parameter, such as the length of the resonators, distance between the resonators and the radiating part of the antennas, the parameters specific to the radiating part of the antennas and the different feeding techniques that are appropriate for the 900 and 1800 bands.

In yet another embodiment, a tri-band tri-feed MIMO antenna system that relies on the disclosed system can be implemented with Wi-Fi equipment. In order to increase the amount of in-band isolation in dual-feed dual-band case, the rectangular antennas are orthogonally positioned with respect to each other. In tri-band tri-feed case, the third dimension needs to be exploited to provide the in-band isolation between the third antenna and the other two antennas. The in-band isolation of the third antenna from the first and second antennas is handled by orthogonal placement of the third antenna with respect to first and second antennas in the third dimension. Besides the placement of the third antenna, the other design concerns would be satisfied by scaling each parameter, such as the length of the resonators, distance between the resonators and the radiating part of the antennas, the parameters specific to the radiating part of the antennas and the different feeding techniques that are appropriate for the first, second, and the third bands.

In yet another embodiment, a dual-feed dual-band 8×8 MIMO antenna system can be implemented with Wi-Fi equipment. In-band isolation in 2×2 dual-band dual-feed MIMO antenna system is provided by the dual resonator system composed of resonator 213 and resonator 214 as depicted in FIG. 2. In order to implement the 8×8 dual-feed dual-band MIMO architecture, eight of the transceiver architectures, should be sequentially concatenated. Therefore, seven in-band dual resonator systems should be designed for 8×8 dual-feed dual-band MIMO antenna systems.

The other design concerns related to out-of-band isolation would be satisfied by scaling each parameter, such as the length of the resonators, distance between the resonators, and the radiating part of the antennas, the parameters specific to the radiating part of the antennas that are appropriate for each of the dual-band dual feed MIMO antenna structure constituting the whole 8×8 dual-feed dual-band MIMO architecture. The utilization of the feeding-type diversity to provide out-of-band isolation in 8×8 dual-feed dual-band MIMO system cancels the necessity of employing eight diplexers to provide the out-of-band isolation. In other words, the disclosed feeding-type diversity design decreases the layout complexity by about eight times, compared with a dual-band single-feed 8×8 MIMO antenna system employing eight diplexers to maintain the coexistence of the low and high frequency components on the same port without interfering with each other.

A multi-feed multi-band MIMO antenna system utilizes both in-band resonators (to decrease the mutual coupling between the antennas in the same frequency band) and out-of-band resonators positioned between the radiating part and the feeding port of each antenna to reject the unwanted out-of-band currents. It employs feeding-type diversity to maintain further out-of-band isolation has been described above. The feeding-type diversity provides an amount of isolation comparable to the isolation provided by conventional diplexers that increase the cost and the layout complexity of the system. Therefore, the feeding-type diversity solution provides a compact, low-cost and easy-to implement out-of-band isolation solution for multi-feed multi-band MIMO antenna systems.

What is claimed is:

1. A multi-feed multi-band multiple input multiple output (MIMO) antenna system comprising:

at least a first antenna and a second antenna orthogonally positioned with respect to each other, wherein the first antenna is operable to operate over a first frequency range and the second antenna is operable to operate over a second frequency range;

at least a first resonator and a second resonator coupled with the first antenna and the second antenna respectively, wherein the first resonator is operable to filter out the second frequency range and the second resonator is operable to filter out the first frequency range; and wherein the first antenna is further coupled with a third resonator and the second antenna is further coupled with a fourth resonator, and wherein the third resonator and the fourth resonator are operable to decrease mutual coupling in the first frequency range and the second frequency range, respectively.

2. The multi-feed multi-band MIMO antenna system of claim 1, wherein the first frequency range includes 2.4 GHz and the second frequency range includes 5 GHz.

3. The multi-feed multi-band MIMO antenna system of claim 1, wherein the first frequency range spans from 890 MHz to 960 MHz and the second frequency range spans from 1710 MHz to 1879 MHz.

4. The multi-feed multi-band MIMO antenna system of claim 1 wherein the first antenna comprises a first feeding port and the second antenna comprises a second feeding port, wherein the first resonator is positioned under a feed line transmitting the first frequency range and the second resonator is positioned in proximity of the second feeding port.

5. The multi-feed multi-band MIMO antenna system of claim 4 wherein the first feeding port is fed with microstrip transmission line in a conductive manner and the second feeding port is fed with proximity coupling corresponding to a capacitive feeding.

6. The multi-feed multi-band MIMO antenna system of claim 1 further comprising:

a third antenna positioned orthogonally with respect to the first and the second antennas, wherein the third antenna is operable to operate over a third frequency range.

7. The multi-feed multi-band MIMO antenna system of claim 1, wherein the antenna system is a dual-feed dual-band 8×8 MIMO antenna system.

8. A wireless communications equipment, comprising a transceiver for sending and receiving wireless signals; and a multi-feed multi-band multiple input multiple output (MIMO) antenna system, wherein the MIMO system comprises:

at least a first antenna and a second antenna orthogonally positioned with respect to each other, wherein the first antenna is configured to operate over a first frequency range and the second antenna is configured to operate over a second frequency range;

at least a first resonator and a second resonator coupled with the first antenna and the second antenna respectively wherein the first resonator is configured to filter out the second frequency range and the second resonator is configured to filter out the first frequency range; and wherein the first antenna is further coupled with a third resonator and the second antenna is further coupled with a fourth resonator, and wherein the third resonator and the fourth resonator are configured to decrease mutual coupling in the first frequency range and the second frequency range, respectively.

9. The wireless equipment of claim 8, wherein the first frequency range includes 2.4 GHz and the second frequency range includes 5 GHz.

10. The wireless equipment of claim 8, wherein the first frequency range spans from 890 MHz to 960 MHz and the second frequency range spans from 1710 MHz to 1879 MHz.

11. The wireless equipment of claim 8, wherein the first antenna comprises a first feeding port and the second antenna comprises a second feeding port, and wherein the first resonator is positioned under a feed line transmitting the first frequency range and the second resonator is positioned in proximity of the second feeding port.

12. The wireless equipment of claim 11, wherein the first feeding port is fed with microstrip transmission line in a conductive manner and wherein the second feeding port is fed with proximity coupling corresponding to a capacitive feeding.

13. The wireless equipment of claim 8 further comprising:

a third antenna positioned orthogonally with respect to the first and the second antennas, wherein the third antenna is configured to operate over a third frequency range.

14. The wireless equipment of claim 8, wherein the antenna system is a dual-feed dual-band 8×8 MIMO antenna system.

* * * * *